US005429082A

United States Patent [19]

Wichelhaus

[11] Patent Number: 5,429,082

[45] Date of Patent: Jul. 4, 1995

[54] METHOD AND AN ARRANGEMENT FOR OPERATING A DRIVE FOR AUXILIARY DEVICES ARRANGED ON AN INTERNAL-COMBUSTION ENGINE

[75] Inventor: Donatus Wichelhaus, Börtlingen, Germany

[73] Assignee: Dr. Ing. h.c.F. Porsche AG, Weissach, Germany

[21] Appl. No.: 119,120

[22] PCT Filed: Dec. 8, 1992

[86] PCT No.: PCT/EP92/02837

§ 371 Date: Sep. 16, 1993

§ 102(e) Date: Sep. 16, 1993

[87] PCT Pub. No.: WO93/14560

PCT Pub. Date: Jul. 22, 1993

[30] Foreign Application Priority Data

Jan. 16, 1992 [DE] Germany ..... 42 00 918.9

[51] Int. Cl.[6] ..... F02B 77/00

[52] U.S. Cl. ..... 123/198 R; 290/40 C

[58] Field of Search ..... 123/198 R, 198 C, 41.44; 290/40 C, 43, 54

[56] References Cited

FOREIGN PATENT DOCUMENTS

| | | | |
|---|---|---|---|
| 2213303C2 | 9/1973 | Germany . | |
| 2732279 | 2/1979 | Germany . | |
| 2801812 | 7/1979 | Germany . | |
| 3124102C2 | 2/1982 | Germany . | |
| 3729772A1 | 3/1989 | Germany . | |
| 60-1328 | 1/1985 | Japan | 123/198 C |

*Primary Examiner*—Noah P. Kamen

*Attorney, Agent, or Firm*—Evenson, McKeown, Edwards & Lenahan

[57] ABSTRACT

A method and arrangement for operating a drive for auxiliary devices arranged on an internal-combustion engine has a differential gear driven by the crankshaft of an internal-combustion engine distributes a driving torque corresponding to the tooth numbers of the transmission to auxiliary devices driven by this transmission. An exciting current which is supplied to an auxiliary device, as a function of load signals and/or cooling water temperature signals, is regulated so that it changes the driving torque of the generator. For maintaining a constant wiring voltage generated by the generator, the rotational speed of the generator therefore changes and, via the differential gear, the rotational speed changes of another auxiliary device. The cooling power of the internal-combustion engine can therefore be regulated as a function of cooling demands or load requirements.

9 Claims, 1 Drawing Sheet

METHOD AND AN ARRANGEMENT FOR OPERATING A DRIVE FOR AUXILIARY DEVICES ARRANGED ON AN INTERNAL-COMBUSTION ENGINE

BACKGROUND AND SUMMARY OF THE INVENTION

The present invention relates to a method and arrangement for operating a drive for a plurality of auxiliary devices arranged on an internal-combustion engine in a motor vehicle, having a differential gear arranged between the internal-combustion engine and the auxiliary devices.

In order to meet the current or voltage requirement of electrical consumers in a motor vehicle, a timed exciting current is fed to a rotary current generator. When there is, for example, a first low rotational generator speed, the exciting current is switched on and off by a regulator at predetermined intervals in such a manner that a specific first medium exciting current is adjusted in the case of a constant wiring voltage. So that the wiring voltage which is permissible for the wiring of the motor vehicle is regulated to its desired value when a second higher rotational generator speed occurs, the regulator changes the timing signal in such a manner that the switched-off time fractions increase and a second medium exciting current is adjusted which is lower than the first. As a result, the wiring voltage, which is a function of the exciting current and the rotational speed and is induced in the generator, remains constant.

It is known to arrange a transmission between an output of an internal-combustion engine and a drive of auxiliary devices. The transmission, as a function of parameters, carries out an adaptation of the rotational driving speed of the auxiliary devices to the rotational output speed of the internal-combustion engine. For example, in the German Patent Document DE-PS 31 24 102, a consumer-current-dependent change-over between a higher and a lower rotational driving speed of an electric generator is disclosed. The transmission connected in front of the electric generator has a clutch actuated by a control device. The clutch carries out the rotational speed change-over in such a manner that the higher rotational driving speed will be maintained only when a low rotational speed of the internal-combustion engine, and at the same time a high current requirement, is present at the electric generator. The current requirement is fed to a regulator for the exciting current which, in turn, is fed to the control device.

In the German Patent Document DE-OS 28 01 812, a planetary transmission is arranged coaxially on a crankshaft end. The sun gear of the planetary transmission is provided with an electromagnetically stallable clutch disk. The ring gear of the planetary transmission drives auxiliary devices. When the sun gear is free, all auxiliary devices are driven at a low rotational speed. When the sun gear is fixed, the rotational output speed of the ring gear will increase so that all auxiliary devices are driven at a joint higher rotational speed. The change-over of the clutch disk takes place as a function of several parameters, for example, of the battery charging current or the cooling water temperature of the internal-combustion engine.

From the above-mentioned prior art, it is known to change over the rotational speed of the drive of the auxiliary devices as a function of parameters between a low and a higher rotational speed. A continuous adaptation or a disconnecting of one or several auxiliary devices is not possible.

It is an object of the invention to provide a method and arrangement for operating a drive for auxiliary devices of an internal-combustion engine which permits a controlled drive of individual auxiliary devices according to the requirements.

This and other objects are achieved by the present invention which provides a method of operating a drive for a plurality of auxiliary devices arranged on an internal-combustion engine in a motor vehicle, having a differential gear arranged between the internal-combustion engine and the auxiliary devices. The method includes switching on and off with a regulator in a timed manner an exciting current. The exciting current is supplied to a first auxiliary device as a function of a rotational speed of the generator such that a wiring voltage induced in the auxiliary device remains substantially constant, wherein the first auxiliary device is a rotary current generator. A signal of the internal-combustion engine is supplied to the regulator as a function of at least one of a load and a cooling water temperature of the internal-combustion engine. This thereby affects the timing of the regulator so as to change a driving torque supplied to the rotary current generator. A rotational generator speed and therefore a rotational driving speed of at least a second auxiliary device is changed by the differential gear to maintain the wiring voltage.

The aforementioned objects are also achieved by an embodiment of the present invention which provides an arrangement for operating a drive for a plurality of auxiliary devices arranged on an internal-combustion engine in a motor vehicle, having a differential gear arranged between the internal-combustion engine and the auxiliary devices. A regulator switches on and off in a timed manner an exciting current supplied to a first auxiliary device as a function of a rotational speed of the generator such that a wiring voltage induced in the first auxiliary device remains substantially constant. A signal of the internal-combustion engine is supplied to the regulator as a function of at least one of a load and a cooling water temperature of the internal-combustion engine to thereby affect the timing of the regulator so as to change a driving torque supplied to the first auxiliary device. A rotational generator speed is changed and therefore a rotational driving speed of at least a second auxiliary device is also changed by the differential gear to maintain the wiring voltage, wherein the differential gear is a planetary transmission. The planetary transmission has first and second outputs. The first output has a ring gear. The first auxiliary device is coupled to the ring gear. The second output has a sun gear. The second auxiliary device is coupled to the sun gear. A planet carrier is coupled to a crankshaft.

Via the intervention into the exciting current fed to the rotary current generator (electric generator), in combination with a differential gear arranged between the internal-combustion engine and the auxiliary devices, this method permits a drive of individual auxiliary devices, such as a water pump, that is controlled according to the requirements.

The power supplied by the internal-combustion engine to the differential gear in the case of a constant rotational speed may be considered to be constant. As a function of the construction of the transmission, the supplied power is distributed to these assemblies at a torque ratio that is constant at first. The required driving torque of the water pump may be considered to be constant while that of the electric generator depends on the intensity of the exciting current.

In the case of a cold start of the internal-combustion engine, a signal is, for example, supplied to the regulator. The signal is a function of the cooling water temperature and changes the timing of the exciting current of the electric generator. When the internal-combustion engine is cold, only a low cooling water throughput or no cooling water throughput at all is desired. The wiring voltage induced in the electric generator is a direct function of the exciting current and of the rotational driving speed of the electric generator. When the exciting current falls and the driving torque of the electric generator is therefore reduced by a certain amount, the rotational driving speed is increased by means of the differential gear. The wiring voltage is therefore kept constant.

Because of the compensating effect of the planetary transmission, the rotational driving speed of the water pump will be reduced.

Advantageously by using this method, when the rotational speed of the internal-combustion engine is low, a high transmission ratio can be achieved with respect to the electric generator. This allows the electric requirements to be covered, for example, also at the idling speed of the engine. On the other hand, it is possible to lower the transmission ratio in the case of high rotational speeds of the internal-combustion engine. As a result, the power consumption and the noise emission caused by the fan wheel of the electric generator will be reduced. The electric generator can therefore be operated in a favorable efficiency range of its characteristic diagram.

Additional advantages are achieved with respect to the second auxiliary device, for example, a water pump. In the case of the known design of a conventionally driven water pump, the power consumption relates to the cooling water flow rate of the internal-combustion engine at full load and maximal rotational speed. In the case of a partial load and low rotational speeds, the cooling requirements of the internal-combustion engine will be reduced to up to a third of the maximal cooling power. The method according to the invention allows a drive of the water pump which is controlled according to the demand. In this case, when the cooling water temperature is low, the differential gear reduces the rotational driving speed of the water pump and, when the internal-combustion engine is warmed up, increases it corresponding to the increased cooling requirements.

In an advantageous embodiment of the invention, the supply of the signal that is a function of the load or the cooling water temperature only takes place when it falls below a predetermined limit value for the cooling water temperature. When the actual cooling water temperature is below the limit value, the timing of the exciting current will be changed in such a manner that this exciting current will fall. As a result, the driving torque of the electric generator will be reduced, and its rotational speed will rise. Consequently, the rotational speed of the water pump will decrease.

In certain embodiments, a locking device is arranged between the output of the planetary transmission and the water pump. The locking device stops the water pump in the case of a cold start. This increases the rotational speed of the electric generator. With a controllable design of this locking device, the cooling power can in addition be regulated between one third and zero of the maximal cooling power.

Other objects, advantages and novel features of the present invention will become apparent from the following detailed description of the invention when considered in conjunction with the accompanying drawings.

DETAILED DESCRIPTION OF THE DRAWINGS

Figure 1:
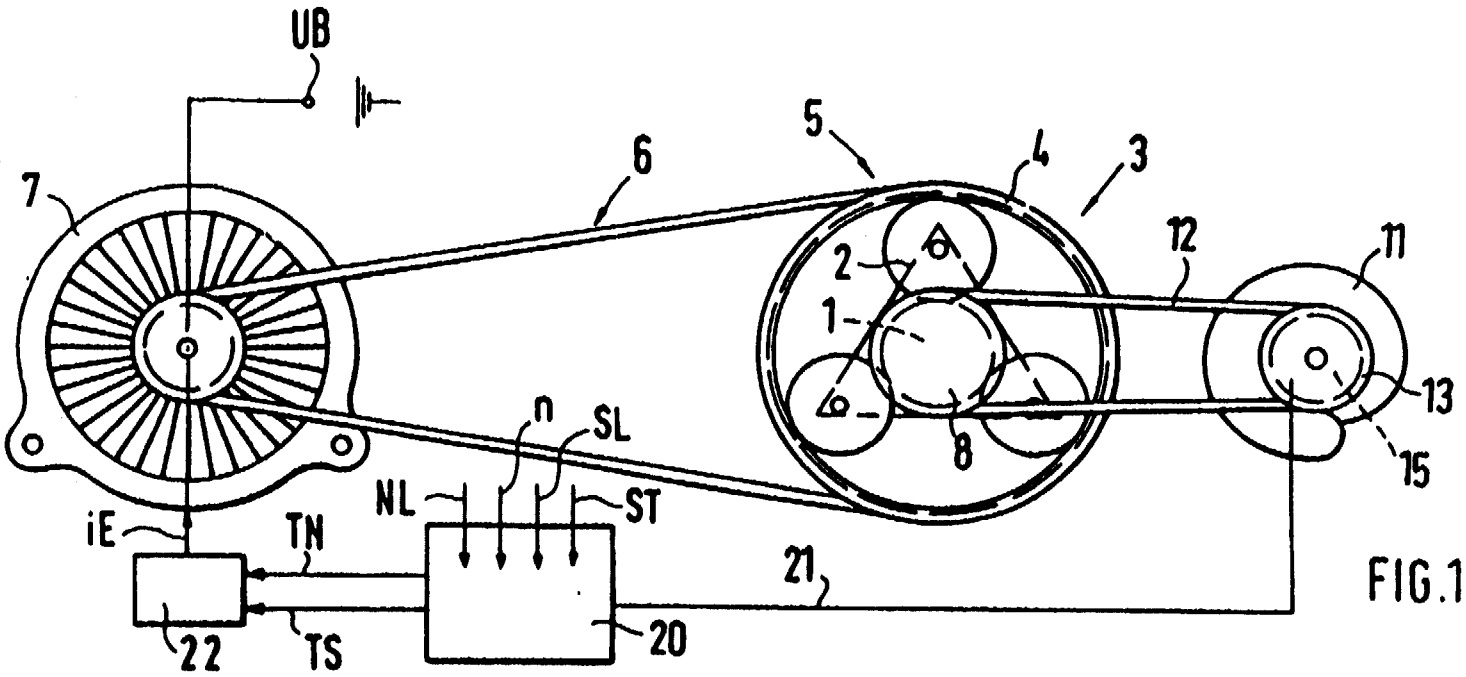
FIG. 1 is a schematic view of an embodiment according to the present invention of a drive for auxiliary devices on an internal-combustion engine having auxiliary devices.
Figure 2:
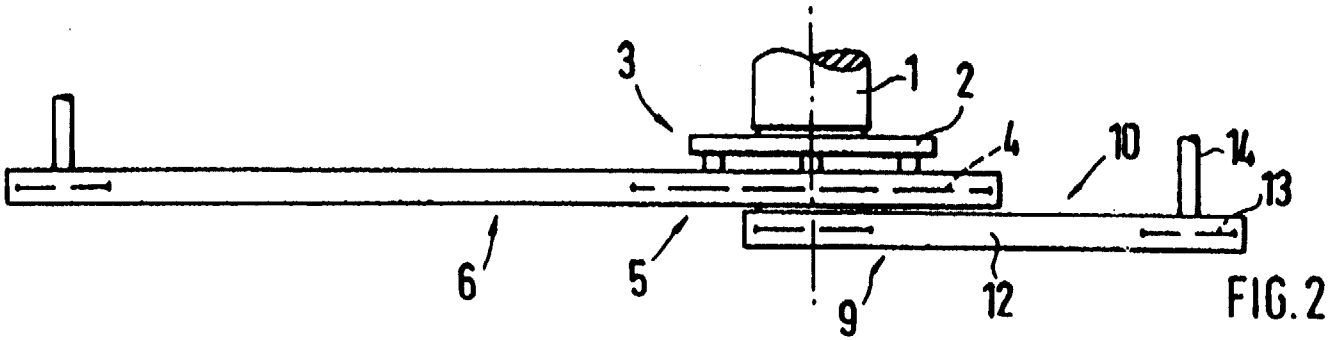
FIG. 2 is a top view of the drive according to FIG. 1.

A drive for auxiliary devices is driven by a crankshaft 1. The drive is arranged at the end face of an internal-combustion engine which is not shown. The crankshaft 1 is connected with a planet carrier 2 of a differential gear constructed as a planetary transmission 3. A first output 5 is constructed as a ring gear 4. The first output 5 by means of a wind-around gear 6, a rotary current generator 7 acting as an electric generator.

A second output 9 acts as a sun gear 8. The second output 9 is connected with a water pump 11 by means of another wind-around gear 10. A belt 12 of this gear 10 winds around a disk 13 of the water pump 11. In this case, an electromagnetic clutch 15, which acts as the locking device, is arranged between this disk 13 and a shaft 14 of the water pump 11.

A control unit 20 processes the rotational speed NL of the generator 7, the rotational speed n of the internal-combustion engine, a load-dependent signal SL and a signal ST which is a function of the cooling water temperature. A lower limit value GT for the signal ST is stored in the control unit 20. According to the demand, the clutch 15 is switched on and off via line 21 by the control unit 20. A regulator 22 supplies an exciting current iE to the generator 7 as a function of the rotational speed NL. The regulator 22 is supplied with a timing signal TN and, as a function of the signals SL and ST, is supplied with a timing signal TS.

During the operation of the internal-combustion engine when the signal ST is above the limit value GT, the timing of the exciting current iE takes place in a known manner as a function of the rotational generator speed NL by way of the signal TN.

All power PG transferred from the internal-combustion engine into the differential gear, corresponding to the tooth numbers of the planetary transmission 3, is divided into a driving torque ML with the rotational speed NL supplied to the generator 7, and a driving torque MW with a rotational speed NW supplied to the water pump 11.

The wind-around gear 6 has a transmission ratio of one to two point five (1:2.5); that of transmission 10 amounts to one to one (1:1). The torque ratio ML/MW is a function of the characteristic diagrams of the auxiliary devices in which the power is entered above the rotational driving speed, and may be assumed, for example, to have a value of four.

If, for example, in the case of a cold start, the limit value GT is exceeded, the timing signal TS is superimposed on the timing signal TN. As a function of the demand, the exciting current iE will directly control the driving torque ML and will indirectly, by way of the planetary transmission 3, control the rotational speed NW of the water pump 11.

A changing of the rotational speed LM of the electric generator by, for example, 1,000 revolutions per minute, because of the 1:2.5 transmission ratio of the wind-around gear 6, results in a changing of the rotational speed of the ring gear 4 by 400 revolutions per minute. Corresponding to the torque ratio ML/MW of four, the rotational speed NW of the water pump will therefore change by 1,600 revolutions per minute.

For achieving a particularly fast warm-up of the internal-combustion engine, when there is a falling-below the limit value GT by a certain amount, the water pump 11 may be stalled via the clutch 15 disconnecting the shaft 14 from the gear 10. The rotational speed NL will increase, and for keeping the wiring voltage UB constant, the exciting current iE is lowered further. In the case of a clutch 15 that is designed to be controllable, the cooling power can additionally be regulated in the range of from zero to approximately 0.3 of the full-load cooling power.

The load signal SL which is, for example, a direct function of the throttle valve position on the internal-combustion engine, will only influence the regulator 22 as long as ST is below the limit value GT.

As a modification of the above-described embodiment, the crankshaft 1 may, for example, be connected with the sun gear 8. The water pump 11 may be connected with the planet carrier 2. Likewise, a second transmission gear may be arranged between the crankshaft 1 and the differential gear. Furthermore, additional auxiliary devices, such as a secondary air pump required in the case of a cold start, may be installed in the drive for the auxiliary devices.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A method of operating a drive for a plurality of auxiliary devices arranged on an internal-combustion engine in a motor vehicle, having a differential gear arranged between and operatively coupling the internal-combustion engine and the auxiliary devices, comprising:

switching on and off with a regulator, in accordance with timing signals supplied to the regulator, an exciting current supplied to a first auxiliary device as a function of a rotational speed NL of the first auxiliary device such that a wiring voltage UB induced in the first auxiliary device remains substantially constant, wherein the first auxiliary device is a rotary current generator;

supplying a signal SL, ST of the internal-combustion engine to the regulator as a function of at least one of a load and a cooling water temperature of the internal-combustion engine to thereby affect the timing of the regulator so as to change a driving torque ML supplied to the rotary current generator;

changing a rotational generator speed NL and therefore a rotational driving speed NW of at least a second auxiliary device by the differential gear to maintain the wiring voltage UB.

2. A method according to claim 1, wherein the signal is supplied to the regulator only when said signal falls below a lower limit value of the signal that is a function of the cooling water temperature.

3. A method according to claim 2, further comprising timing the exciting current via the regulator so that the driving torque becomes lower when the signal falls below the limit value and, increasing the rotational driving speed of the rotary current generator via the differential gear to maintain the wiring voltage, and to thereby lower the rotational driving speed of the second auxiliary device.

4. A method according to claim 1, further comprising sensing with a control unit 20 at least a rotational speed of the internal-combustion engine, a rotational speed of the rotary current generator, a load signal and a temperature signal, and supplying a first timing signal to the regulator as a function of the rotational speed, and a second timing signal to the regulator as a function of the load signal and the temperature signal.

5. A method according to claim 4, wherein said differential gear comprises a planetary transmission and wherein said second auxiliary drive is a water pump and further comprising operating a clutch arranged between the planetary transmission and the second water pump by the control unit via a line when the signal falls below a limit value by a predetermined amount to disengage the water pump.

6. An arrangement for operating a drive for a plurality of auxiliary devices arranged on an internal-combustion engine in a motor vehicle, having a differential gear arranged between and operatively coupling the internal-combustion engine and the auxiliary devices, in which a regulator switches on and off in accordance with timing signals an exciting current supplied to a first auxiliary device as a function of a rotational speed of the first auxiliary device such that a wiring voltage induced in the first auxiliary device remains substantially constant, and a signal of the internal-combustion engine is supplied to the regulator as a function of at least one of a load and a cooling water temperature of the internal-combustion engine to thereby affect the timing of the regulator so as to change a driving torque supplied to the first auxiliary device, wherein, for maintaining the wiring voltage, a rotational generator speed and therefore a rotational driving speed of at least a second auxiliary device is changed by the differential gear, the second auxiliary device being a water pump, wherein the differential gear is a planetary transmission, the planetary transmission having: first and second outputs, the first output having a ring gear, the first auxiliary device being coupled to the ring gear, the second output having a sun gear, the second auxiliary device being coupled to the sun gear; and a planet carrier for the planetary transmission being coupled to a crankshaft.

7. An arrangement according to claim 6, wherein the planetary transmission includes a first wind-around gear between the ring gear and the first auxiliary device, and a second wind-around gear between the sun gear and the second auxiliary device.

8. An arrangement according to claim 6, further comprising a clutch connected with the control unit between the second output and the second auxiliary device.

9. The arrangement according to claim 6, wherein the first auxiliary device is a rotary current generator.

* * * * *